United States Patent [19]

Bälz

[11] Patent Number: 4,480,785

[45] Date of Patent: Nov. 6, 1984

[54] METHOD AND APPARATUS FOR THE REGULATED TRANSFER OF HEAT FROM A PRIMARY STEAM NETWORK TO A HEAT CONSUMER

[76] Inventor: Helmut Bälz, Koepffstrasse 5, D-7100 Heilbronn, Fed. Rep. of Germany

[21] Appl. No.: 385,387

[22] PCT Filed: Sep. 21, 1981

[86] PCT No.: PCT/DE81/00149

§ 371 Date: May 17, 1982

§ 102(e) Date: May 17, 1982

[87] PCT Pub. No.: WO82/01057

PCT Pub. Date: Apr. 1, 1982

[30] Foreign Application Priority Data

Sep. 23, 1980 [DE] Fed. Rep. of Germany ..... 3035779

[51] Int. Cl.[3] ..... B60H 1/00

[52] U.S. Cl. ..... 237/6; 237/67; 237/59; 237/74

[58] Field of Search ..... 237/67, 74, 6, 8 R, 237/59

[56] References Cited

U.S. PATENT DOCUMENTS 1,065,568 6/1913 Ward ..... 237/6

2,789,770 4/1957 Hans-Martin Pape ..... 237/67

*Primary Examiner*—Henry Bennett

*Attorney, Agent, or Firm*—Frishauf, Holtz, Goodman and Woodward

[57] ABSTRACT

In a method for the regulated transfer of heat from a primary steam network to a heat consumer, the supply flow of which is at a predetermined overpressure and the return flow of which is at a relatively lower pressure, the steam withdrawn from the steam network in accordance with the heat consumption on the part of the consumer is cooled down to the point of condensation by the withdrawal of heat by means of a secondary medium, while a predetermined overpressure relative to the supply pressure of the heat consumer is maintained. The overpressure in a jet pump is then reduced to the supply pressure of the heat consumer, generating a corresponding driving force for the supply flow, and secondary medium heated up in the course of the cooling down of the steam is mixed with the supply flow.

In order both to save plumbing fixtures and to assure that a pressure-elevating pump behind the jet pump is not necessary, the condensate is accumulated in order to regulate the temperature at the heat consumer, and the condensate accumulation is regulated solely by adjusting the propulsion nozzle of the jet pump.

5 Claims, 1 Drawing Figure

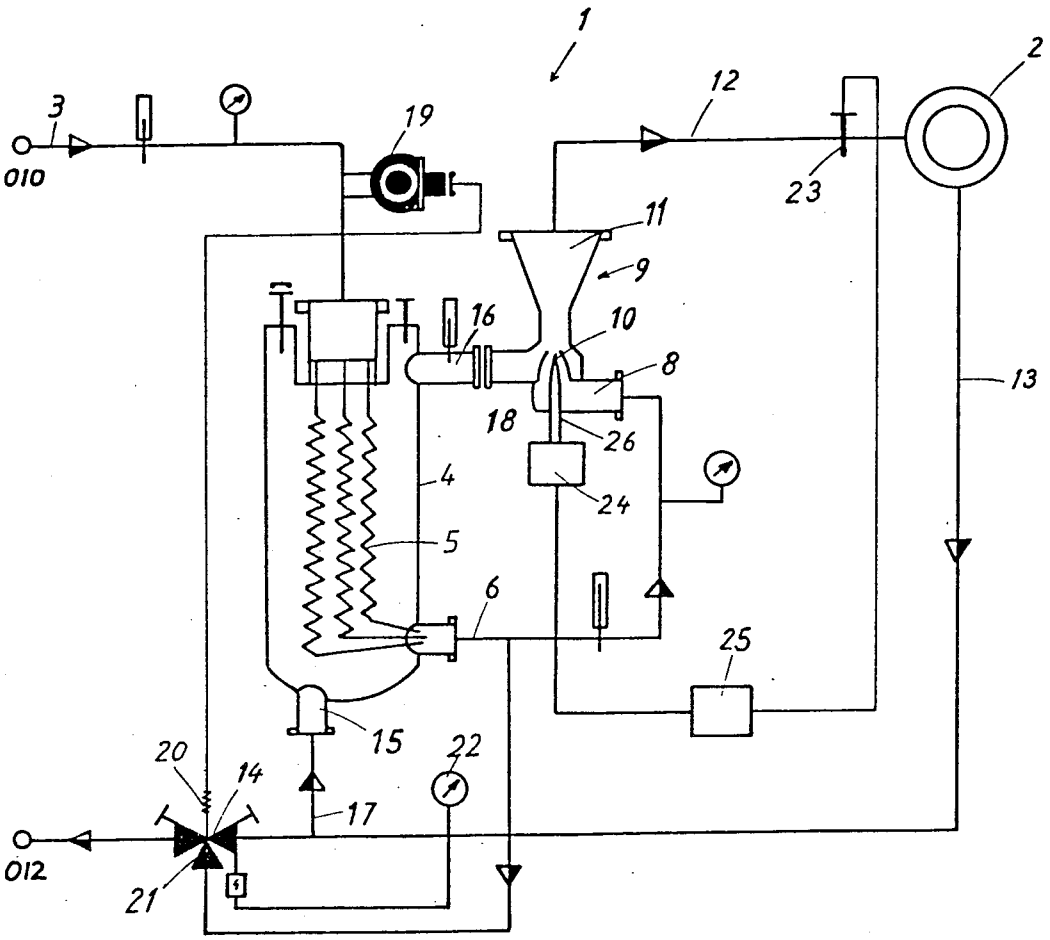
1
2
3
4
5
6
8
9
10
11
12
13
14
15
16
17
18
19
20
21
22
23
24
25
26
010
012

METHOD AND APPARATUS FOR THE REGULATED TRANSFER OF HEAT FROM A PRIMARY STEAM NETWORK TO A HEAT CONSUMER

The invention relates to a method for the regulated transfer of heat from a primary steam network to a heat consumer, the supply flow of which is at a predetermined overpressure and the return flow of which is at a relatively lower pressure. The steam withdrawn from the steam network in accordance with the heat consumption on the part of the heat consumer is cooled down to the point of condensation by the withdrawal of heat by a secondary medium, while a predetermined overpressure relative to the supply pressure of the heat consumer is maintained. The overpressure is then reduced in a jet pump to the supply pressure of the heat consumer, generating a corresponding driving or pumping force for the supply flow, and secondary medium which has been heated in the course of the cooling down of the steam is then added to the supply flow.

The invention further relates to an apparatus for the regulated transfer of heat from a primary steam network to a heat consumer, having a heat exchanger regulated by the accumulation of condensate in accordance with the temperature at the heat consumer. The heat exchanger is connected on the steam side with the steam network and on the condensate side with the injection nozzle of a jet pump located in the supply conduit of the heat consumer. The injection nozzle of the jet pump is exposed to the condensate, which is at a predetermined overpressure, and on the intake side the jet pump is located in a secondary circuit of the heat exchanger in which secondary medium heated by the steam is flowing; the secondary medium can be admixed with the supply to the heat consumer in a predetermined proportion.

Background

In an older method and an older apparatus to carry-out such a method, the heat exchanger is connected via a multiple-function valve to the steam line of the primary steam network. The pipe coils for condensation in the heat exchanger are connected to the injection or propulsion nozzle of a jet pump, and a line which serves as the supply conduit leads from the jet pump to the heat consumer, the return flow of which discharges via a pressure maintenance valve into the condensate return line of the primary steam network. After the heat consumer in the direction of flow, but before the pressure maintenance valve, a line branches off with the secondary medium is diverted from the condensate which is to be returned, and this secondary medium is fed into the associated supply connection of the heat exchanger.

Once the secondary medium in the heat exchanger has been heated by the condensation of the steam, it passes through a further connecting line to the intake side of the jet pump; from there, it is then added to the condensate flowing out of the heat exchanger in order to transfer heat to the heat consumer.

The regulation of the temperature of the supply of the heat consumer is effected via the multiple-function valve provided on the steam side, by way of which the condensate accumulation in the heat exchanger is also regulated at the same time.

There is a pressure loss at the multiple-function valve. Under certain operating conditions it is then necessary to provide a pressure-elevating pump in the supply conduit for the heat consumer following the jet pump. The pressure-elevating pump being electrically operated.

The Invention

It is an object to improve the method discussed above in such a manner that on the one hand, fewer plumbing fixtures are required and on the other, it is not necessary to provide a pressure-elevating pump following the jet pump.

Briefly, the temperature of the secondary medium being supplied to the heat consumer is sensed and the injection nozzle of the jet jump is then so controlled, as a function of temperature, that the jet pump pumps or supplies more or less of a mixture of secondary medium condensate from the steam supply, at over pressure, as required in order to regulate the temperature at the heat consumer in accordance with a predetermined level.

Preferably, the supply flow of the secondary medium, which is supplied to the heat exchanger and then to the consumer is branched off from the return flow of the heat consumer.

As a result, the advantage is attained that virtually the entire steam pressure of the network is available for use in driving or pumping the condensate through the jet pump; thus sufficient driving force is available to deliver the admixed secondary medium and the condensate to the heat consumer with an appropriate overpressure. With this method and this apparatus, a circulating pump is not required regardless of in any operational situation.

The cold secondary medium can efficaciously be diverted from the cooled return flow of the heat consumer.

In order to prevent the system from running dry in the event of disruptions in operation, a pressure maintenance valve can be located downstream of the diversion point of the secondary circuit in the flow direction.

In order to prevent an excess accumulation of condensate in the steam supply line in the event that very little heat is withdrawn from the heat exchanger or the steam network, it is possible for the pressure maintenance valve to have a further connection, which is connected to the connecting line between the condensate side of the heat exchanger and the jet pump. A level-indication transducer controlling the pressure regulating valve is located in the steam line for the heat exchanger. In order to remove excess condensate, the pressure maintenance valve is reversible by means of the level-indication transducer in such a manner that the condensate bypasses the heat consumer and the jet pump and can be carried away directly into the condensate return conduit of the steam network.

Depending on requirements, a hot-water heater can be included in the heat exchanger.

DRAWING

In single FIGURE of the drawing, is a system diagram of an exemplary embodiment.

The steam water-heating system 1 shown in the drawing serves to transfer heat from a primary steam network 010 to a heat consumer indicated by reference numeral 2. Depending upon the embodiment of the system, the heat consumer 2 may be embodied as a heating, ventilating, air conditioning, industrial or hot-water heating system having heating bodies or registers or heating devices or the like.

The system has a heat exchanger 4 connected via a conduit 3 to the steam network 010. A bundle of pipe coils 5 is disposed in the heat exchanger. The pipes coils are connected on the steam side with the conduit 3 and on the condensate side to a connecting line 6. The connecting line 6 leads from the pipe coil bundle 5 to the propulsion nozzle connection 8 of a jet pump having a variable injection, or propulsion nozzle 10, and the receptor nozzle or diffusor 11 of the jet pump 9 is connected to a supply conduit 12 of the heat consumer 2. A return conduit 13 leads from the heat consumer 2 via a multiple-function valve 14 to the condensate collector conduit 012 of the steam network.

The heat exchanger 4 also has two connections 15 and 16 for the secondary medium, which is carried in a countercurrent process through the heat exchanger 4 and diverted from the return conduit 13 via a line 17 at a location ahead of the multiple-function valve 14 in the flow direction and is then fed into the connection 15. After flowing through the heat exchanger 4, the secondary medium flows out of the connection fitting 16 of the heat exchanger 4 and from there reaches the intake side 18 of the jet pump 9.

In order to prevent such an accumulation of condensate in the heat exchanger 4 that it would overflow and return to the steam network 10 in the event of low heat withdrawal, a level-indication transducer 19 is provided above the heat exchanger 4 in the connecting line 30. The level-indication transducer controls a magnet 20 of the magnetically controlled multiple-function valve 14, which is connected via a further connection 21 with the conduit 6 carrying the condensate. The multiple-function valve 14 also forms as a pressure maintenance valve, and it is controlled via a pressure transducer 22 provided in the return conduit 13 in such a way that a predetermined pressure is maintained within the conduit 13.

In order to control the supply flow temperature of the heat consumer 2 and thus in order to control the quantity of heat transferred in the system 1, a temperature measurement sensor 23 is located in the supply conduit 12 and is connected to a control device 25 acting upon an actuator 24. The actuator 24 serves to regulate the propulsion nozzle 10, which in the exemplary embodiment is provided with a nozzle needle 26 for varying the nozzle cross section. The arrangement comprising the actuator 24 and the jet pump 9 is designed such that with the aid of the adjustable propulsion nozzle 10, the flow of condensate into the connecting line 6 or in the supply conduit 12 and to the heat consumer 2 is infinitely adjustable between a zero flow rate and the maximum flow rate.

Operation: steam flows out of the steam network 010 via the conduit 3 into the bundle of coils 5 of the heat exchanger 4, where it condenses, heating up the secondary medium circulating through the bundle of coils 5. The secondary median is part of the return flow from the consumer 2, branched off from return line 13 through line 17 and supplied to the heat exchanger 4 at inlet 15. The resultant condensate is substantially at the pressure of the steam network 010 and flows via the conduit 6 to the adjustable propulsion nozzle 10 of the jet pump 9. Depending upon the position of the nozzle needle 26 of the adjustable propulsion nozzle 10, a greater or lesser amount of condensate flows through the jet pump or into the diffusor 11 and thus into the supply conduit 12 of the heat consumer 2. As a result of the flow through the jet pump 9, secondary medium which has been heated up by the condensing steam is aspirated out of the heat exchanger at the intake side 18 via the connection fitting 16 and is mixed with the condensate flowing in at the diffusor 11 in accordance with the position of the adjustable injection or propulsion nozzle 10, so that what is finally supplied to the heat consumer 2 is a mixture of condensate and secondary medium. Depending upon how much heat is withdrawn by the heat consumer 2, the supply temperature measured in the supply conduit 12 by the measurement sensor 23 is above or below a predetermined set-point value, so that by means of the control device 25, the actuator 24 and thus the nozzle needle 26 are readjusted such that the set-point temperature is adhered to. If the supply temperature is above the set-point temperature, the adjustable propulsion nozzle 10 is closed, and thus a greater amount of condensate accumulates in the heat exchanger 4, and less steam is withdrawn from the steam network 010. At the same time, the driving force behind the propulsion nozzle 10 drops, and less secondary medium is pumped out of the heat exchanger 4 and delivered to the heat consumer 2. If the temperature measured in the supply conduit 12 is below the set-point temperature, that is, if the heat consumer 2 draws off more heat, then the opposite process takes place; the propulsion nozzle 10 is opened, controlled by the control device 25 and the actuator 24, and the throughput of both condensate and secondary medium is increased.

If there is an extremely small amount of heat removed by the heat consumer 2 and the condensate in the bundle of coils 5 or the heat exchanger 4 increases to an impermissible extent, then the level-indication transducer 19 responds and thereupon opens the connection 21 of the multiple-function valve 14 via the magnet 20, so that condensate is withdrawn from the conduit 6 directly into the return conduit 012 of the steam network, bypassing the jet pump 9 and the heat consumer 2, with the aid of the steam pressure exerted on the condensate. The multiple-function valve in this case serves simultaneously, together with the pressure transducer 22, to maintain a predetermined minimum pressure in the return conduit 13 and to prevent the system from possibly running dry.

Since no additional regulating fixtures are provided in the conduit 3, that is, the connection between the steam network 010 and the heat exchanger 4, the driving force available for use at the adjustable propulsion nozzle 10 is sufficient in all operational settings to pump the condensate, together with the heated secondary medium, through the heat consumer 2.

Depending upon the intended usage, it is possible to provide a hot-water heater, not shown, in the heat exchanger.

I claim:

1. An apparatus for the regulated transfer of heat from a primary steam network (010, 012) to a heat consumer (2), having a heat exchanger (4) regulated by means of condensate accumulation in accordance with the temperature at the heat consumer;

the heat exchanger (4) being connected on the steam side with the steam network (010) and on the condensate side with the injection nozzle of the jet pump (9) located in the supply conduit of the heat consumer, the injection nozzle of the jet pump being exposed to condensate at a predetermined overpressure, and the jet pump being located on the intake side in a secondary circuit (17, 15, 16) of the heat exchanger (16) in which secondary medium is heated by the steam flow, the jet pump mixing secondary medium and condensate at over pressure with a predetermined proportion to supply the heat consumer, characterized in that the heat exchanger (4) is connected directly to the steam network (010);

and the jet pump (9), in order to regulate the amount of heat transferred, includes a regulatable injection nozzle (10); an actuator (24), a control device (25) and a temperature sensor (23) located to measure the temperature of the supply of the heat consumer (2); being provided, the temperature sensor signalling the temperature of the mixture being supplied to the consumer to the controller, the controller controlling said actuator (24) to regulate the regulatable nozzle to control said proportion to maintain a predetermined temperature at the sensor, and hence at the consumer.

2. An apparatus as defined by claim 1, characterized in that the secondary circuit (17, 15, 16) of the heat exchanger (4) branches off from a return conduit (13) of the heat consumer (2) downstream of the heat consumer (2) in the flow direction.

3. An apparatus as defined by claim 2, characterized in that a pressure maintenance valve (14) is located downstream of the branching off point of the secondary circuit (17, 15, 16) in the flow direction.

4. An apparatus as defined by claim 3 characterized in that the pressure maintenance valve (14) has a further connection (21), which is connected to a connecting line (6) between the condensate side of the heat exchanger (4) and the jet pump (9), and that a level-indication transducer (19) is provided controlling the pressure regulating valve (14), located in a connecting line (3) between the steam network (010) and the heat exchanger (4), the level-indication transducer controlling the pressure maintenance valve (14) to remove or drain excess condensate from the return conduit from the consumer (2) into the condensate return line (012) of the steam network (010, 012), bypassing the heat consumer (2) and the jet pump (9).

5. An apparatus as defined by claim 1, characterized in that a hot-water heater is included in the heat exchanger (4).

* * * * *